US007584845B2

(12) United States Patent
Cheng

(10) Patent No.: US 7,584,845 B2
(45) Date of Patent: Sep. 8, 2009

(54) WRENCH RACK

(76) Inventor: Chin-Shun Cheng, No 37-2, Ching-Dau 1st Street, Taichung (TW) 404

( * ) Notice: Subject to any disclaimer, the term of this patent is extended or adjusted under 35 U.S.C. 154(b) by 477 days.

(21) Appl. No.: 11/616,856

(22) Filed: Dec. 27, 2006

(65) Prior Publication Data

US 2008/0156754 A1 Jul. 3, 2008

(51) Int. Cl.
*B65D 85/28* (2006.01)
*A47F 7/00* (2006.01)
*A47G 1/10* (2006.01)

(52) U.S. Cl. ..... 206/376; 206/372; 206/806; 211/70.6; 248/316.7

(58) Field of Classification Search ..... 206/372, 206/373, 376, 377, 378; 211/70.6, 69; 248/316.7
See application file for complete search history.

(56) References Cited

U.S. PATENT DOCUMENTS 3,370,696 A * 2/1968 Norris ..... 294/161
5,598,924 A * 2/1997 McCann ..... 206/372
5,967,340 A * 10/1999 Kao ..... 211/70.6
6,315,121 B1 * 11/2001 Hansen ..... 206/376
6,401,923 B1 * 6/2002 Huang ..... 206/376
6,536,611 B2 * 3/2003 Chen ..... 211/70.6
6,758,350 B2 * 7/2004 Lin ..... 211/70.6
6,837,382 B2 * 1/2005 Chen ..... 211/70.6
6,976,582 B2 * 12/2005 Chen ..... 206/376
7,055,689 B2 * 6/2006 Chen ..... 206/376
7,175,032 B2 * 2/2007 Ling ..... 211/70.6
7,178,670 B2 * 2/2007 Chen ..... 206/376
2006/0118500 A1 * 6/2006 Chen ..... 211/70.6

* cited by examiner

*Primary Examiner*—Luan K Bui
*Assistant Examiner*—Jose S Stephens, III

(57) ABSTRACT

The present invention relates to an improved structure of wrench rack. The structure includes a rack, a sliding board and at least one lock piece. The rack has a sliding groove and a plurality of clips that are provided on both sides of the sliding groove in pairs. Every pair of clips is spaced in parallel for retaining different sizes of wrenches. Each of the clips consists of two opposite jaws, one of the jaws is equipped with an elastic piece to press on the wrench, and thus the wrench is retained between the jaws stably. The sliding board connects in sliding with the rack, and a plurality of positioning hooks are provided on one side of the sliding board in parallel, the positioning hooks can grip wrenches by sliding with the sliding board, so as to prevent the wrench from taking out. The lock piece can lock the sliding board on the rack when the positioning hook locks the wrench.

16 Claims, 10 Drawing Sheets

A

A

WRENCH RACK

FIELD OF THE INVENTION

The present invention generally relates to wrench racks, and more particularly to a wrench rack that is able to lock and release wrenches, which prevents the wrenches from being taken away easily from the wrench rack.

BACKGROUND OF THE INVENTION

A conventional wrench rack includes a board provided with at least one clip that consists of two parallel jaws. To use the wrench rack, just insert the wrench handle into said two jaws and the wrench will be retained on the wrench rack. However, the conventional clip device does not have a better lock device, the wrench is easy to fall off or be taken away from the wrench rack, that causes inconvenience of use and storage.

SUMMARY OF THE INVENTION

The primary objective of the present invention is to provide an improved structure about the wrench rack that is able to lock a wrench, prevent the wrench from moving, and operate easily. The structure includes a rack, a sliding board and at least a lock piece. The rack has a sliding groove and a plurality of clips that are provided on both sides of the sliding groove in pairs. Every pair of clips is placed in parallel for retaining different sizes of wrenches. Each of the clips consists of two opposite jaws, one of the jaws is equipped with an elastic piece to press on the wrench, and thus the wrench is retained between the jaws stably. The sliding board connects in sliding with the rack, and a plurality of positioning hooks are provided on one side of the sliding board in parallel, the positioning hooks can grip wrenches by sliding with the sliding board, so as to prevent the wrench from taking out. The lock piece can lock the sliding board on the rack when the positioning hook locks the wrench.

The present invention will become more obvious from the following description when taken in connection with the accompanying drawings that show, for purposes of illustration only, a preferred embodiment in accordance with the present invention.

DETAILED DESCRIPTION OF THE PREFERRED EMBODIMENT

Figure 1:
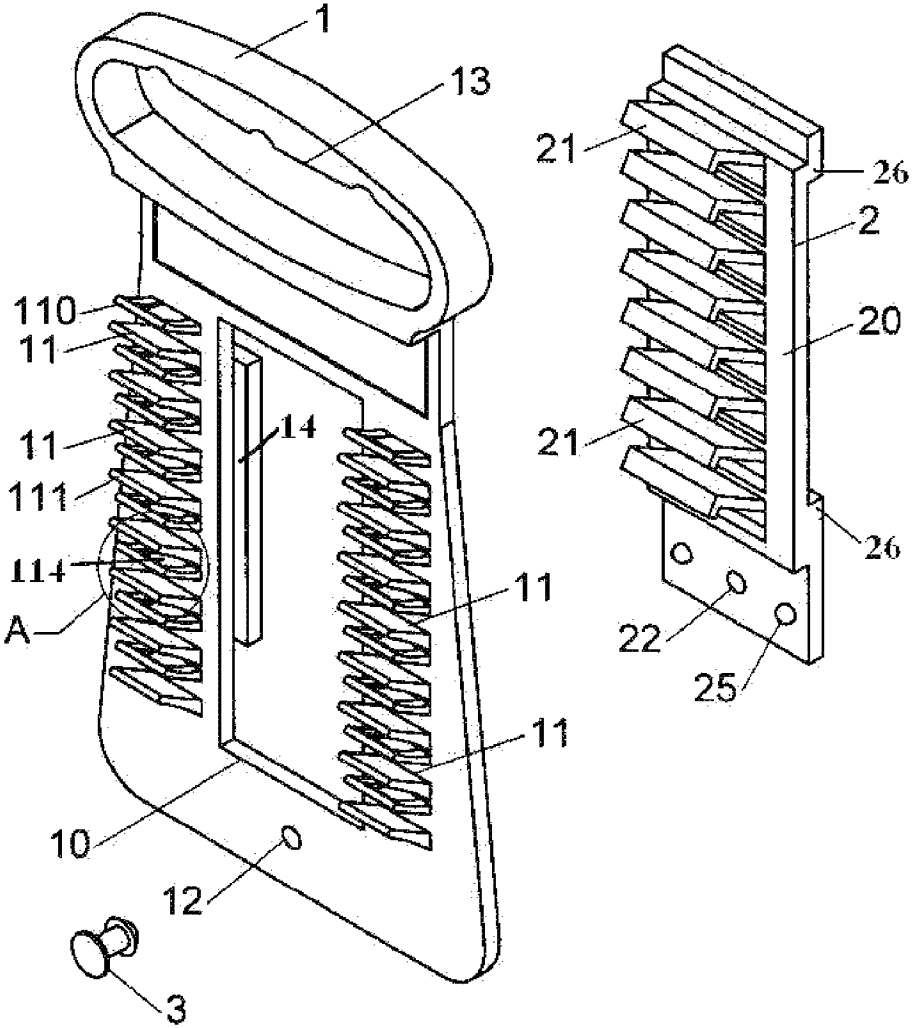
FIG. 1 is a perspective view of the first embodiment of the present invention.

Referring to FIG. 1, according to the embodiment of the present invention, a wrench rack includes a piece of rack 1 that has a front side and a rear side. Two guiding tracks 14 are formed on the rear side. A long sliding groove 10 penetrated the front side and rear side is located on the center of the rack 1, on the front side a plurality of clips 11 are provided on both sides of the sliding groove 10. Every two clips 11 pair one set and each of the clips 11 comprises two opposite jaws 110/111 for retaining a wrench. A fixing hole 12 is defined under the sliding groove 10 of the rack 1 and an opening 13 is defined in the upper portion of the rack 1 for hanging or carrying.

A sliding board 2 has an extruding portion 20 on the front side for being sliding-fitted into the sliding groove 10 of the rack 1. On the extruding portion 20 a plurality of spaced L-figure positioning hooks 21 line up in parallel, the positioning hooks 21 can grip wrenches by sliding with the sliding board 2. The sliding board 2 has a lock hole 22 relative to the fixing hole 12.

A lock piece 3 penetrates the fixing hole 12 and the lock hole 22 to lock the sliding board 2 to the rack 1. The lock piece 3 may be an expanding fixing bolt that is made of plastic material, which has a compressible head.

Figure 2:
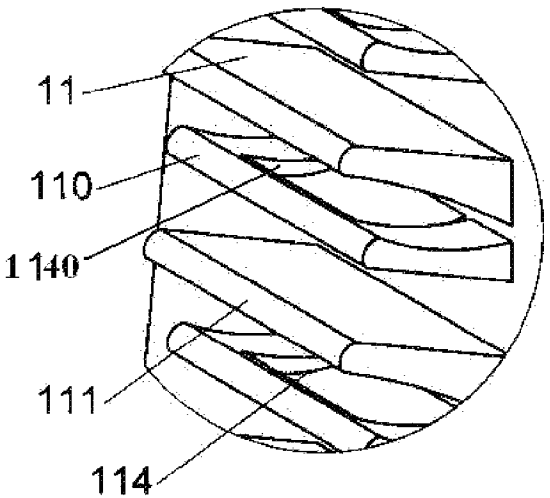
FIG. 2 is a partial enlarged view of the first embodiment of the present invention.
Figure 12:
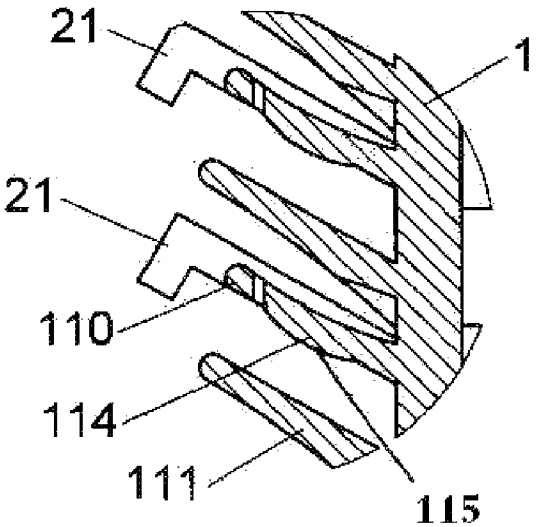
FIG. 12 is a partial enlarged view of FIG. 11.
Figure 11:
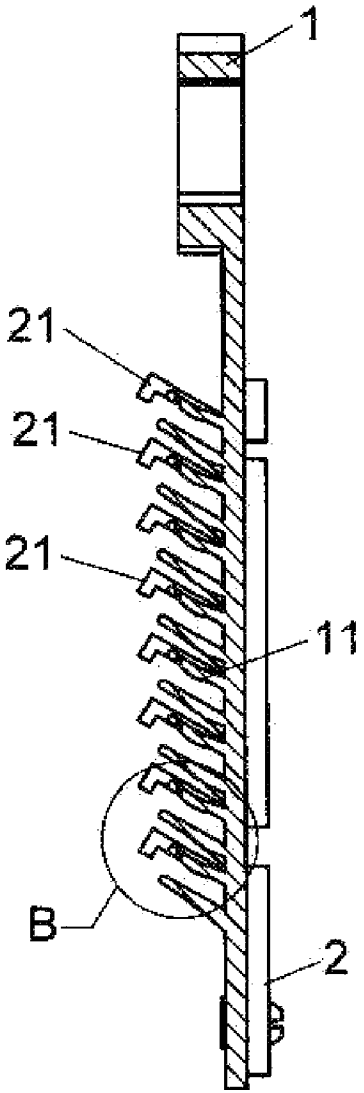
FIG. 11 is a cross-sectional view of one embodiment of the present invention showing that the elastic piece has a protrusion.
Figure 13:
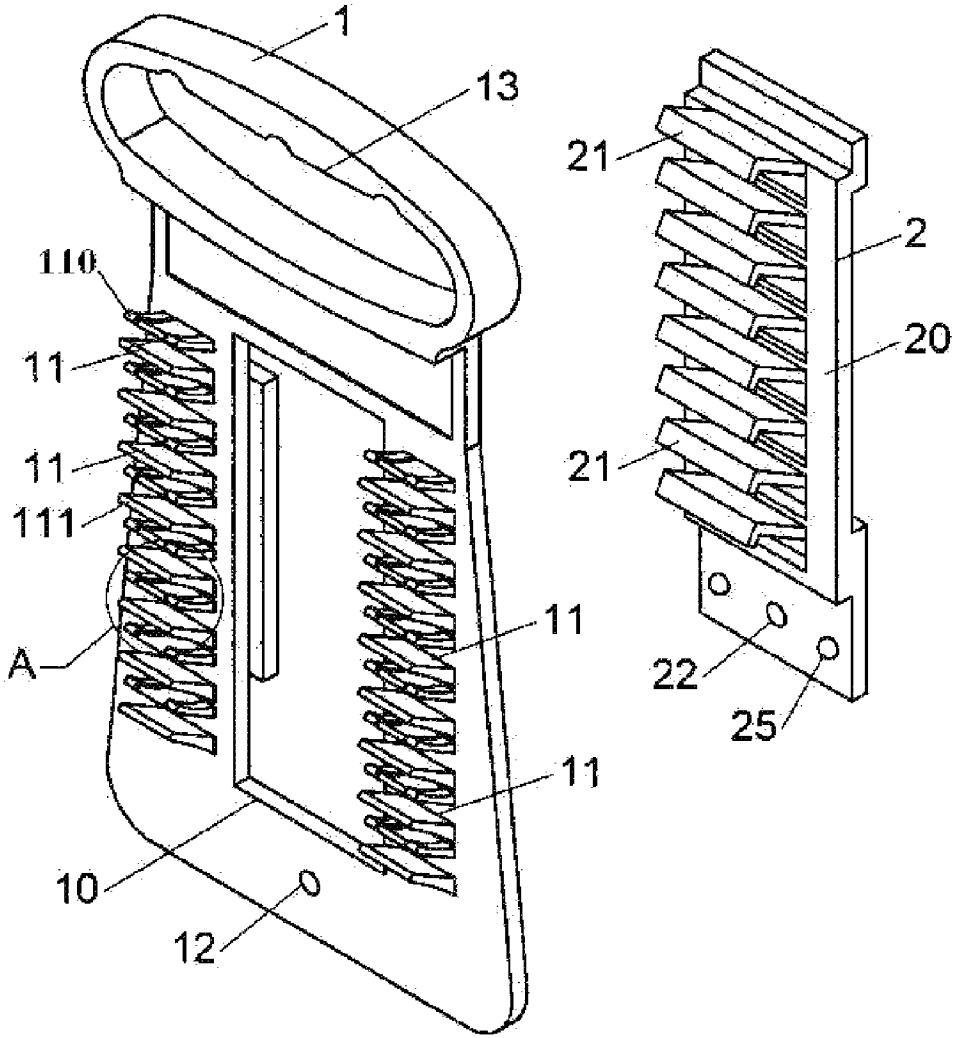
FIG. 13 is a perspective view of one embodiment of the present invention showing that the jaw has an open groove.
Figure 14:
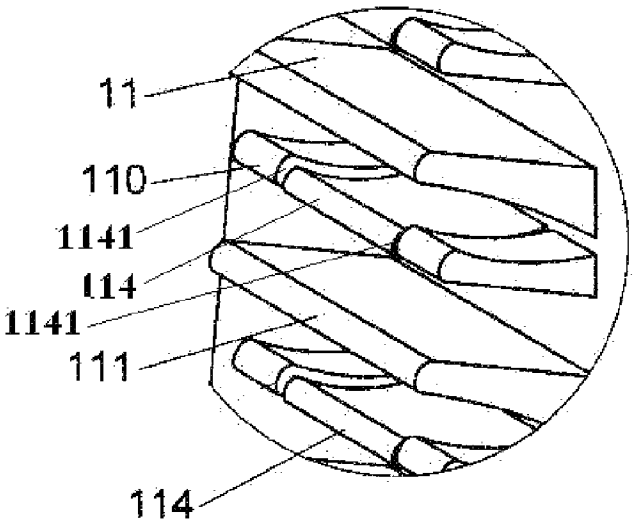
FIG. 14 is a partial enlarged view of FIG. 13.
Figure 16:
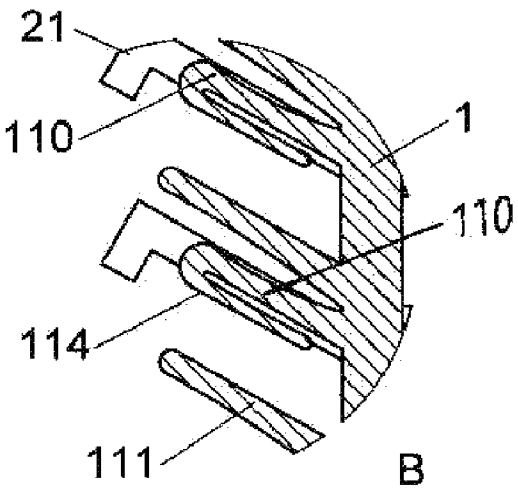
FIG. 16 is a partial enlarged view of FIG. 15.
Figure 15:
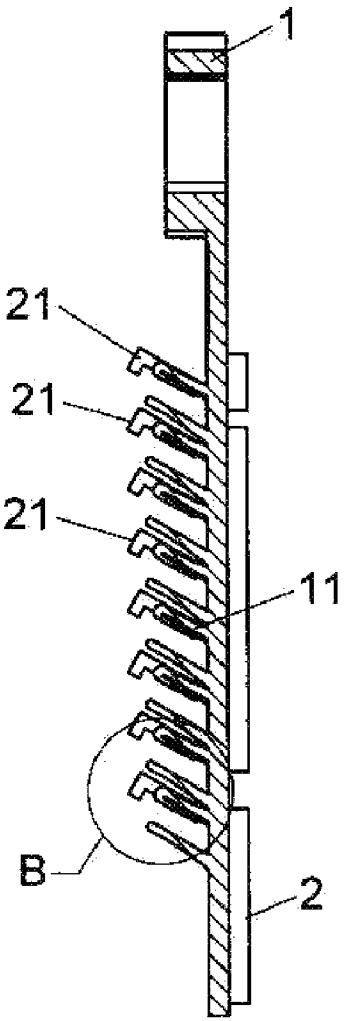
FIG. 15 is a cross-sectional view of one embodiment of the present invention showing that the elastic piece is formed from extension of the jaw.

Referring to FIG. 2, the clip 11 consists of two opposite jaws 110/111, and one of the jaws 110 is equipped with an elastic piece 114 that is elastic and able to press the wrench. The elastic piece 114 may be located on the inside of the jaw 110. One embodiment shown in FIG. 2 is a closed groove 1140 that is formed between the elastic piece 114 and the jaw 110, wherein the groove 1140 may be in figure of U or an arc. Another embodiment shown in FIGS. 13 and 14 is an open groove 1141 that is formed on each two sides of the elastic piece 114 between the elastic piece 114 and the jaw 110. Referring to FIGS. 15 and 16, the elastic piece 114 is formed reversely from extension of the jaw 110. As shown in FIGS. 11 and 12, a protrusion 115 that is formed on the pressing side of the elastic piece 114 would press on the wrench 4 and then pressing force of the elastic piece 114 on the wrench 4 would be increased.

As shown in FIG. 1, the sliding board 2 includes two positioning fringes 26. The distance between two positioning fringes 26 is longer than the length of the guiding tracks 14. While the sliding board 2 moves relative to the rack 1, one of the positioning fringes 26 touches the ends of the guiding tracks 14 to stop the sliding board 2 getting out completely from the guiding tracks 14.

Figure 3:
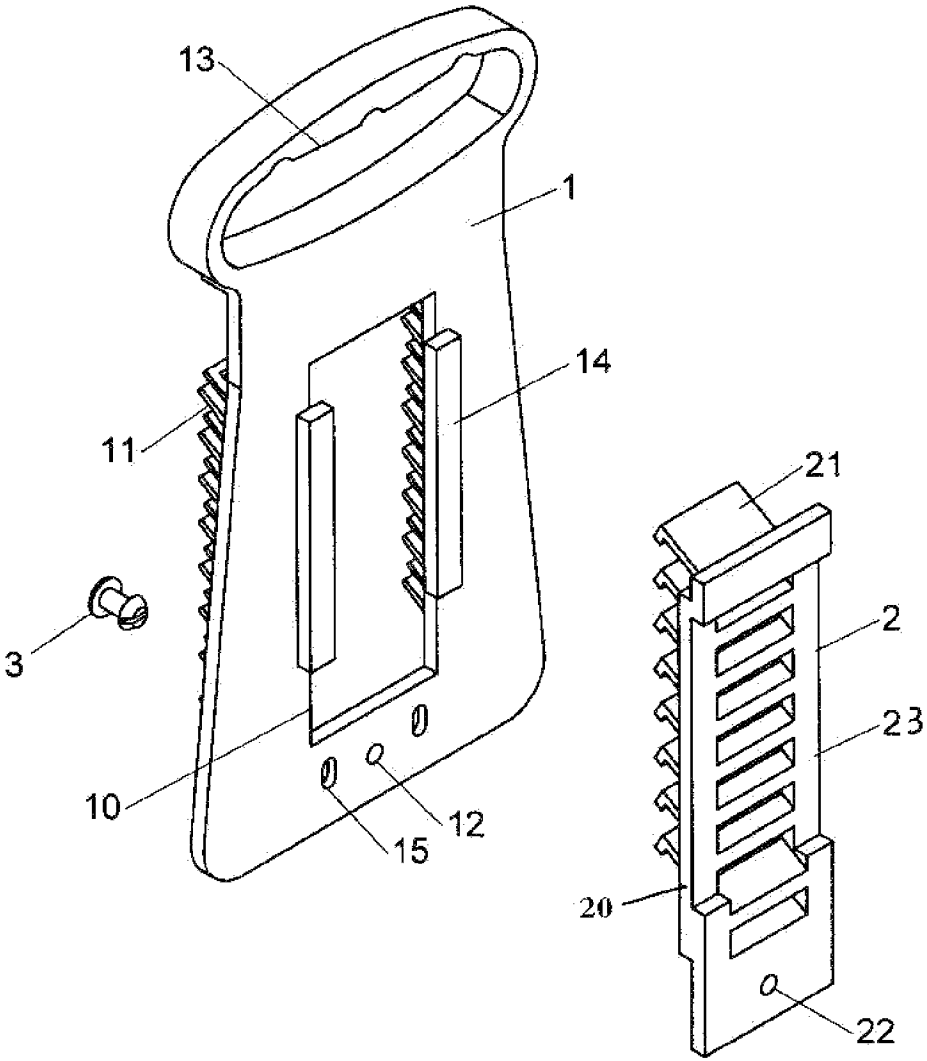
FIG. 3 is a rear view of FIG. 1.
Figure 4:
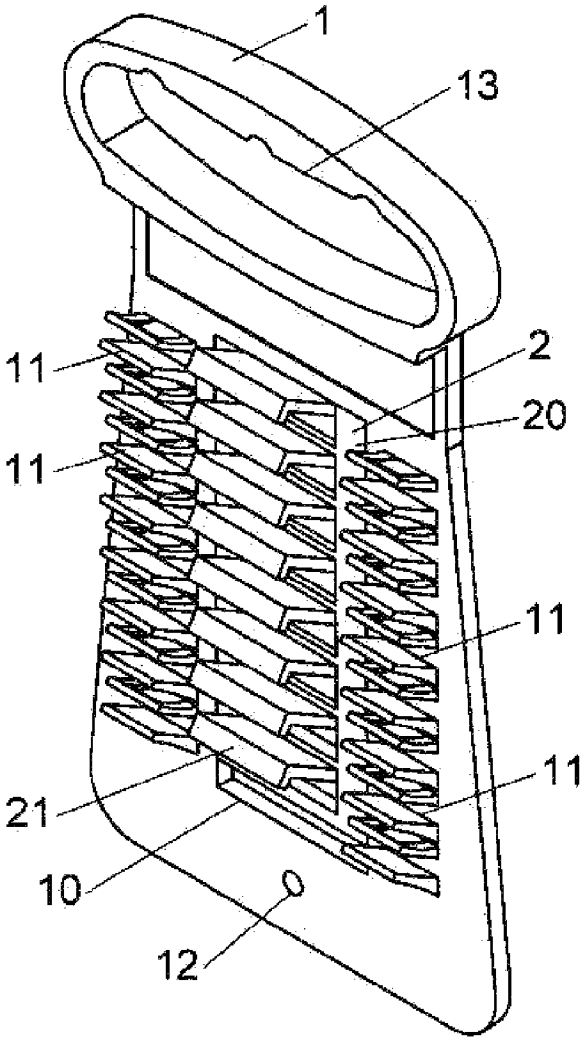
FIG. 4 is a perspective view of assembly of FIG. 1.
Figure 5:
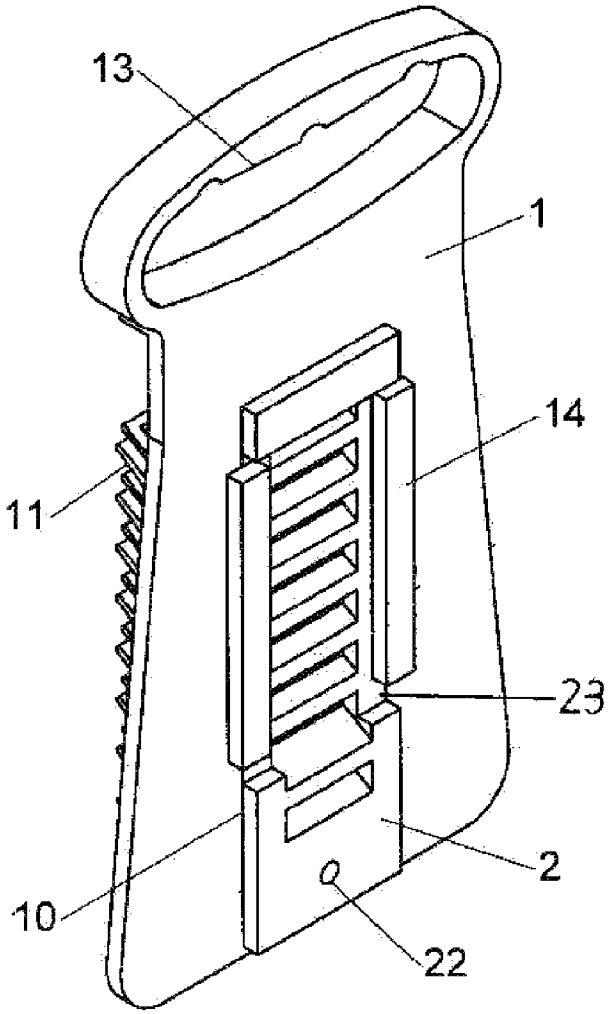
FIG. 5 is a perspective view of assembly of FIG. 3.
Figure 6:
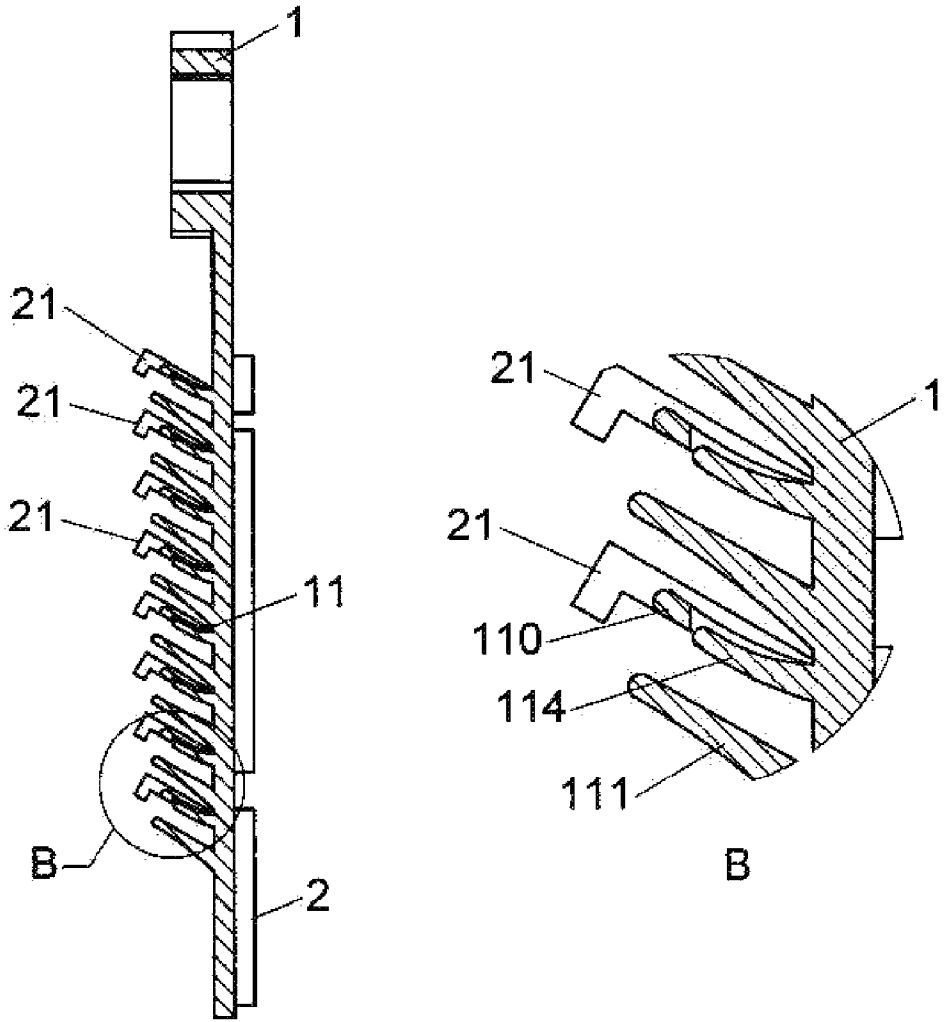
FIG. 6 is a cross-sectional view of the first embodiment of the present invention.

Referring to FIG. 3, the rack 1 has two apertures 15, and the sliding board 2 has two hemi-spherical bulges 25 for inserting into the apertures 15. The diameters of two ends of the aperture 15 are bigger than the center, so that when the bulge 25 slides to two ends of the aperture 15, which will have an effect of positioning.

Figure 8:
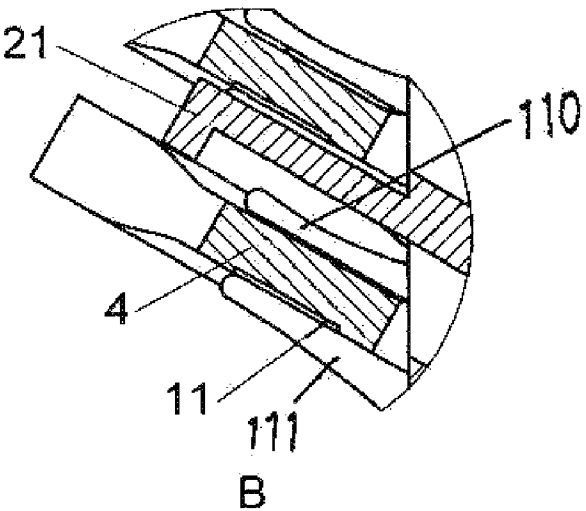
FIG. 8 is a partial enlarged view of FIG. 7.
Figure 7:
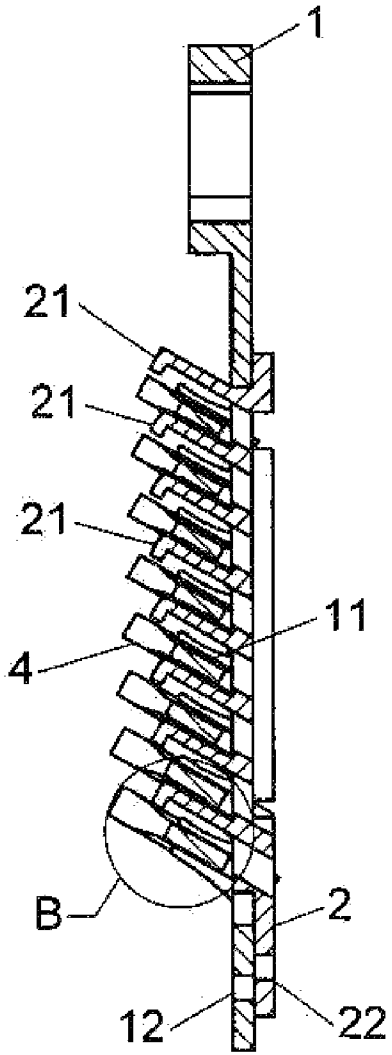
FIG. 7 is a cross-sectional view of the first embodiment of the present invention showing that a wrench is not locked.

Referring to FIGS. 7 and 8, the wrench 4 is inserted into the clip 11, but the sliding board 2 and the positioning hooks 21 are not moved down yet, the jaws 110/111 already clip the wrench 4 appropriately, just apply a proper pull to the wrench 4 to conquer the gripping force of the jaws 110/111, the wrench 4 can be taken out. The extending direction of the jaws 110/111 and the rack 1 have an angle that is less than 90.degree, so that when the wrench 4 is positioned on the rack 1, which will has a better visual angle.

Figure 10:
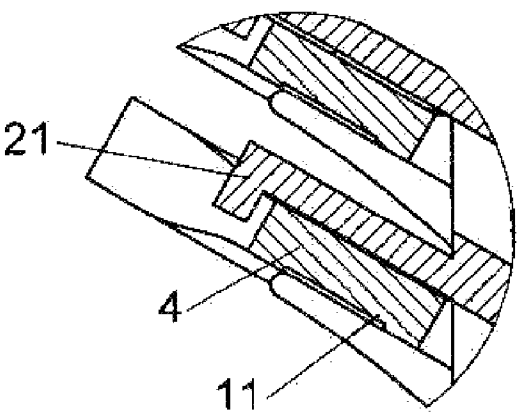
FIG. 10 is a partial enlarged view of FIG. 9.
Figure 9:
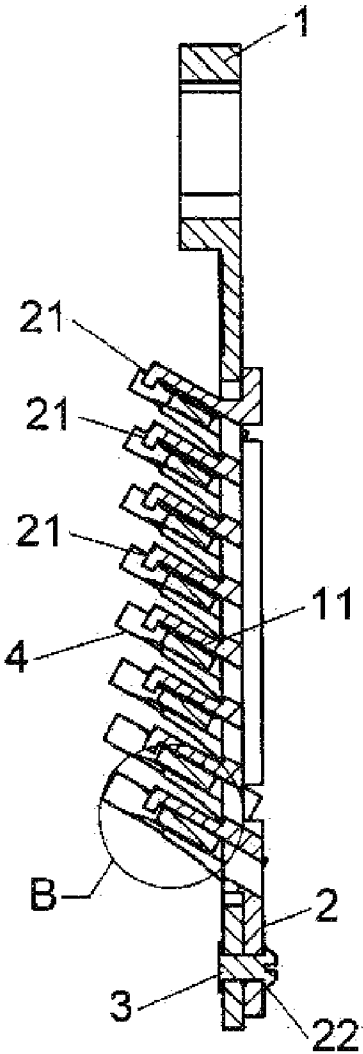
FIG. 9 is a cross-sectional view of the first embodiment of the present invention showing that a wrench is locked.

Referring to FIGS. 9 and 10, while the sliding board 2 is moved downward, the positioning hooks 21 are also moved downward, and then the positioning hook 21 hook the handle of the wrench 4. The wrench 4 is fastened on the rack 1 and unable to be taken out easily. Meanwhile, the lock hole 22 of the sliding board 2 is positioned to the fixing hole 12 of the rack 1, insert the lock piece 3 into the lock hole 22 and the fixing hole 12, so that the sliding board 2 and the rack 1 are coupled together and the wrench 4 is locked thereon. To get the wrench 4, take out the lock piece 3 from the lock hole 22 and the fixing hole 12, and then push the sliding board 2 upward for the positioning hook 21 to depart from the wrench 4.

In the general, the present invention uses the clips of the rack and the positioning hooks of the sliding board to lock the wrench effectively, so that the objective of preventing the wrench from falling off is attained.

While we have shown and described the embodiment in accordance with the present invention, it should be clear to those skilled in the art that further embodiments may be made without departing from the scope of the present invention.

What is claimed is:

1. A wrench rack comprising:

a piece of rack having a front side and a rear side, a sliding groove penetrating the front side and rear side, two guiding tracks being formed on the rear side and a plurality of clips being provided on the front side, every two said clips pairing one set and being provided on both sides of said sliding groove to retain a wrench;

a sliding board including two positioning fringes for being sliding-fitted into said two guiding tracks of said rack, thus said two side fringes being located on the rear side of said rack, said sliding board having a plurality of positioning hooks being able to protrude to the front side of said rack, said positioning hooks can grip the wrenches by sliding with said sliding board; and at least a lock piece for penetrating said sliding board and said rack, when said positioning hooks hooking the wrench, said sliding board and said rack can be coupled together.

2. The wrench rack as claimed in claim 1, wherein each of said clips consists of two opposite jaws.

3. The wrench rack as claimed in claim 2, wherein an extending direction of said jaw and said rack have an angle that is less than 90 degree.

4. The wrench rack as claimed in claim 2, wherein one of said jaws is equipped with an elastic piece that is elastic and able to press on the wrench.

5. The wrench rack as claimed in claim 4, wherein said elastic piece includes a protrusion that is formed on the pressing side thereof.

6. The wrench rack as claimed in claim 4, wherein said elastic piece is located on the inside of said jaw and a closed groove is formed between said elastic piece and said jaw.

7. The wrench rack as claimed in claim 6, wherein said closed groove is in figure of U.

8. The wrench rack as claimed in claim 6, wherein said closed groove is an arc.

9. The wrench rack as claimed in claim 4, wherein said elastic piece is located on the inside of said jaw and an open groove that is formed on each two sides of said elastic piece between said elastic piece and said jaw.

10. The wrench rack as claimed in claim 4, wherein said elastic piece is formed reversely from extension of said jaw.

11. The wrench rack as claimed in claim 1, wherein an upper portion of said rack has an opening for hanging or carrying.

12. The wrench rack as claimed in claim 1, wherein said sliding board has an extruding portion for being sliding-fitted into said sliding groove of said rack.

13. The wrench rack as claimed in claim 1, wherein said rack has at least one fixing hole and said sliding board has at least one lock hole, said fixing hole and said lock hole being penetrated by said lock piece.

14. The wrench rack as claimed in claim 13, wherein said lock piece is an expanding fixing bolt that is made of plastic material and has a compressible head.

15. The wrench rack as claimed in claim 1, wherein said rack includes at least one aperture that has two bigger diameter ends and said sliding board has a bulge for movable inserting into said aperture, said bulge being positioned when moving to said two ends of said aperture.

16. The wrench rack as claimed in claim 1, wherein a distance said two positioning fringes is longer than the length of said guiding tracks, while said sliding board moving relative to said rack, one of said positioning fringes touching the ends of said guiding tracks to stop said sliding board getting out completely from said guiding tracks.

* * * * *